United States Patent [19]

Sofia

[11] 4,192,506

[45] Mar. 11, 1980

[54] RACQUET SAFETY DEVICE

[76] Inventor: Anthony A. Sofia, 9035 W. Cermak Rd., North Riverside, Ill. 61466

[21] Appl. No.: 915,147

[22] Filed: Jun. 13, 1978

[51] Int. Cl.[2] ..... A63B 59/00

[52] U.S. Cl. ..... 273/73 R

[58] Field of Search ..... 273/9, 29 A, 67 R, 67 A, 273/72 R, 72 A, 73 R, 73 C, 76, 174, 78, 84 R; 293/71 R; 272/62; 2/16, 22; 128/82, 132 R, 149; 74/558, 558.5; 297/455, 456, 461

[56] References Cited

U.S. PATENT DOCUMENTS

| | | | |
|---|---|---|---|
| 2,099,521 | 11/1937 | Herkimer | 273/72 R |
| 2,197,409 | 4/1940 | Jackson | 74/558 |
| 2,369,145 | 2/1945 | Kent | 273/73 R |
| 3,300,250 | 1/1967 | Dollgener et al. | 273/9 X |
| 3,574,379 | 4/1971 | Jordan | 273/78 X |
| 3,582,072 | 6/1971 | Stueck | 273/73 C X |
| 3,585,639 | 6/1971 | Enicks | 128/132 R X |
| 3,664,668 | 5/1972 | Held | 273/73 C |
| 3,869,106 | 3/1975 | Gregov | 273/DIG. 8 |
| 3,879,250 | 4/1975 | Rankin | 273/76 X |
| 4,128,239 | 12/1978 | Grenadier | 273/67 R |
| 4,130,277 | 12/1978 | Marks | 273/67 R |

FOREIGN PATENT DOCUMENTS

| | | | |
|---|---|---|---|
| 698375 | 11/1964 | Canada | 273/67 A |

*Primary Examiner*—Richard J. Apley

*Attorney, Agent, or Firm*—Gary, Juettner & Pyle

[57] ABSTRACT

The head portion of the frame of a racquet is provided with a conforming cover of a cushioning material or resilient pad extending around and embracing the periphery of the head, in order to minimize the possibility of injury during play.

1 Claim, 2 Drawing Figures

RACQUET SAFETY DEVICE

BACKGROUND OF THE INVENTION

The popularity of racquet sports has increased in recent years, and this is particularly true of the game of racquetball, which is played indoors with a soft ball and a short racquet. The game is played within the confines of an enclosed rectangular room wherein the walls, ceiling and floor are utilized for the bounce of the ball. Two, three or four players may play at the same time.

Due to the confines of the playing area and the nature of the sport, the players are frequently in close proximity to each other. Regardless of the caution exercised by the players, a very serious injury can occur if a player is accidentially struck with a racquet. The frames of the racquets are made from stiff or relatively rigid materials such as wood, plastic or metal having angular edges, and the racquets are typically swung at high speed. Serious head and bone injuries and lacerations have been reported.

In addition to the above safety problem, the walls of racquetball courts frequently become damaged or chipped due to players who accidently strike the walls with a racquet when attempting to hit the ball. The court balls are usually specially constructed and are difficult or expensive to repair.

Some racquets are provided with a thin strip of somewhat resilient material at the top of the head, but such material is employed primarily to increase end weight and to prevent damage to the frame.

SUMMARY OF THE INVENTION

The present invention provides a means for substantially improving the safety of racquets and the games associated therewith by providing a rounded, protective, resilient cushion around outside surface and side surfaces of the head portion of the racquet frame. The pad serves to absorb a great deal of the impact whenever the frame is accidently brought into contact with another player or with the playing surfaces, all without any significant impairment to the performance of the racquet.

DESCRIPTION OF THE PREFERRED EMBODIMENT

Figure 1:
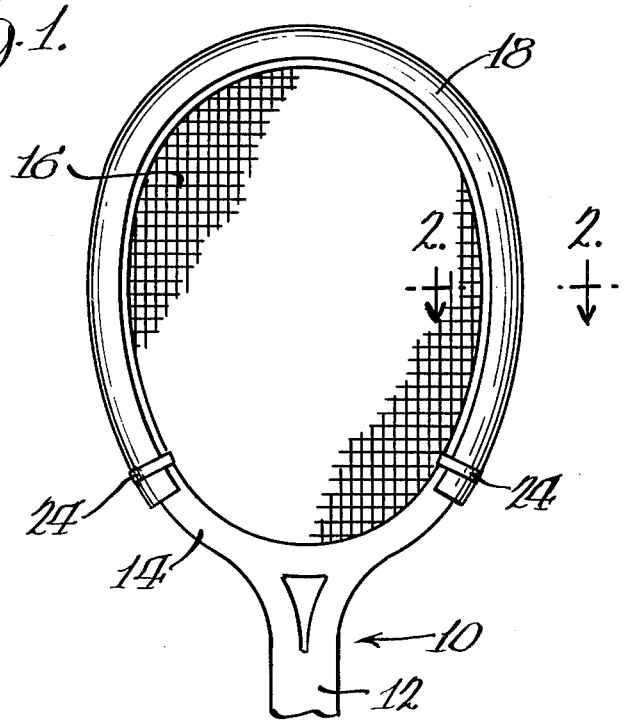
FIG. 1 is a fragmentary view of a racquet having the safety device of the present invention installed thereon.

FIG. 1 illustrates a typical or conventional racquet 10 to which the present invention is applicable, said racquet generally comprising a relatively rigid frame having a handle at one end 12 and a round or oval head 14 defining a ball striking surface 16, such as the network of strings is shown. Although the device of the present invention is being described in connection with a racequetball racquet, it will be apparent that the device could be used beneficially on any type of racquet, such as squash, tennis, badminton racquets and the like.

Figure 2:
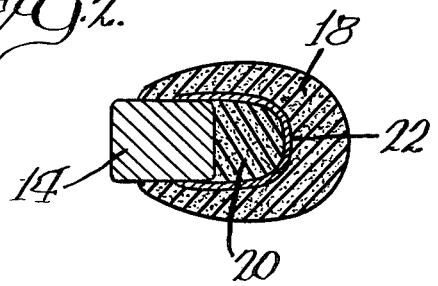
FIG. 2 is a sectional view taken along line 2—2 of FIG. 1.

As shown in FIGS. 1 and 2, a protective pad 18 is provided around a major portion of the circumference of the head 14. Preferably, the pad 16 is sufficiently wide to wrap over or cover the outer exposed corners of the frame.

In the embodiment shown, a first continuous strip 20 of resilient material is secured around the outermost surface 22 of the head. The means of securement is not critical, and the strip 20 may be secured in the position shown by adhesive or other suitable means.

Thereafter, the external pad 18 is fitted around the perimeter of the head and is secured in position by any suitable means, such as adhesive, cord wrapping or the like. Preferably, the pad 18 is of one piece construction and may be additionally secured to the frame by bonds 24 near the ends of the pad, or at locations around the perimeter.

The pad 18 and the strip may be of one piece construction, as long as the arrangement is such that a good fit is achieved. The pad 18, for example, may be constructed from a slit length of resilient tubing such that the tubing defines a C-shaped member that may be wrapped over the edges of the frame and will embrace and overlie the side surfaces as well as the outwardly facing surfaces of the frame. The pad 18 preferably terminates just short of the inside surface of the frame defining the ball hitting area, so as not to interfere with the ball when properly struck.

Obviously, a pre-shaped pad could be used advantageously but is not necessary. The padding is preferably composed of a dense, light-weight material that has maximum impact absorption characteristics. Suitable materials, for example, include compressible, flexible or resilient foam or cellular materials, and shape-retaining materials are preferred. Also, the outside surface of the pad 18 may be coated or provided with an abrasion resistant or frictionless surface to minimize wear on the pad and to further improve safety.

It may be seen that the safety device of the present invention provides an energy absorbing layer around the exposed portion racquet head, including the side surfaces, and provides a generally rounded body around the sharp corners of the frame. Since the pad may be constructed from light weight, streamlined materials that fit tightly on the racquet is not impaired. Thus, the safety of the game is considerably improved without any detraction from the enjoyment or play of the sport.

I claim:

1. In combination, a racquet and a safet device mounted thereon, said racquet comprising a head comprising a frame surrounding a striking surface, and a handle extending away from the head, said safety device comprising an elongate member of compressible foam material of constant cross section having a rounded outer impact surface and sufficient thickness to substantially absorb impacts, said member having an inner channel conforming to the shape of the racquet frame and having shoulders on each side overlapping the sides of the racquet frame, said device extending around a portion of the racquet head and terminating at each end short of the handle, said shoulders being spaced away from the striking surface of the racquet to avoid interference therewith, and adhesive means between the channel of the member and racquet frame for removably securing said member to said frame.

* * * * *